US005478153A

United States Patent [19]

Feldkämper

[11] Patent Number: 5,478,153

[45] Date of Patent: Dec. 26, 1995

[54] MULTILAYER SACK OR BAG WITH BOTTOM

[75] Inventor: Richard Feldkämper, Lengerich, Germany

[73] Assignee: Windmöller & Hölscher, Lengerich, Germany

[21] Appl. No.: 269,516

[22] Filed: Jul. 1, 1994

[30] Foreign Application Priority Data

Jul. 6, 1993 [DE] Germany ..... 43 22 520.9

[51] Int. Cl.[6] ..... B65D 33/18

[52] U.S. Cl. ..... 383/114; 383/88; 383/111; 383/123

[58] Field of Search ..... 383/123, 109, 383/124, 88, 114, 115

[56] References Cited

U.S. PATENT DOCUMENTS

| | | | |
|---|---|---|---|
| 2,429,505 | 10/1947 | Ashman | 383/123 |
| 3,526,354 | 9/1970 | Gibbs | 383/123 |
| 4,498,192 | 2/1985 | Becker et al. | 383/123 |

FOREIGN PATENT DOCUMENTS

| | | | |
|---|---|---|---|
| 0123784 | 4/1988 | European Pat. Off. . | |
| 2738448 | 3/1979 | Germany | 383/109 |
| 4142257 | 5/1992 | Japan | 383/121 |

*Primary Examiner*—Stephen P. Garbe
*Attorney, Agent, or Firm*—Keck, Mahin & Cate

[57] ABSTRACT

The invention concerns a multilayer sack or bag with side folds which consists of several tubular webs with side folds inserted one into the other, in which arrangement at least one open end is closed by a bottom. To form a bottom that is comparatively less thick, the outer tubular web with side folds has a projecting flap that extends over its width. At least one inner tubular web with side folds is inserted into this tubular web with side folds in such a way that it terminates at the distal edge of the flap. The projecting strip extending parallel to the flap of the at least one inner tubular web with side folds is folded over onto the outer side of the outer tubular web with side folds. The tubular webs with side folds, inserted one into the other, are folded together round the outer edge of this folded over strip and are fixed in this position.

1 Claim, 2 Drawing Sheets

MULTILAYER SACK OR BAG WITH BOTTOM

The invention concerns a multilayer sack or bag with side folds.

PRIOR ART

Such a multilayer sack or bag has already been described in EP-B-01 23 784. On the end of the outer tubular web with side folds which is to be closed a side is separated from the side folds by suitable lateral slits for forming the bottom. The remaining part of the assembly of outer tubular web with side folds and the tubular webs with side folds disposed therein is folded along a fold line in such a way that the strip separated from the side folds by the lateral slits stays in position. The folded-over strip and the strip of the rear side that remained in position are folded together once more round the outer edge of the folded strip and are then joined to the bag. The bottom formed by this double fold becomes thick in its folded-together state, and this is undesirable, in particular when such multilayer sacks or bags are being stacked.

OBJECT OF THE INVENTION

It is therefore an object of the invention to provide a sack or bag of the above kind which has a less thickly formed bottom.

SUMMARY OF THE INVENTION

Accordingly the present invention provides a multilayer sack or bag with side folds consisting of several tubular webs with side folds, inserted one into the other, in an arrangement of which at least one open end is closed by a bottom, wherein the outer tubular web with side folds has a projecting flap extending over the width of said outer web; wherein the at least one inserted inner tubular web with side folds ends in register with the distal edge of the flap; wherein the projecting strip extending parallel to the flap of the at least one inner tubular web with side folds is folded over onto the outer side of the outer tubular web with side folds; and wherein the tubular webs with side folds inserted one into the other are folded together round the distal edge of this folded-over strip and are fixed in this position.

The outer tubular web with side folds has a projecting flap that extends over the width. Such designs are already known in the state of the art, as stepped bags. Now, in accordance with the present invention, at least the one inserted inner tubular web with side folds is inserted so far that it terminates with the distal edge of the above mentioned flap. The projecting strip of the at least one inner tubular web with side folds, extending parallel to the flap, is folded over onto the outer side of the outer tubular web with side folds. Subsequently, the tubular webs with side folds inserted one into the other are folded round the distal edge of this folded strip and are fixed in this position. The bottom formed in this way is comparatively less thick on one side although it is closed with a seal.

As a rule, in the second fold round the distal edge of the strip which has already been folded over, the fold will be executed in such a way that the flaps of the outer tubular web with side folds will come to lie next to the folded-over strip when being fixed on the outer side of the outer tubular web with side folds.

Preferably the multilayer sack or bag in accordance with the invention consists of paper, for example, packing paper.

BRIEF DESCRIPTION OF THE DRAWINGS

Further objects and advantages of the invention will be explained in greater detail with reference to an example of the embodiment represented in the accompanying drawings. In the drawings:

FIGS. 1*a* to 5*a* show schematic top views of various steps of manufacturing the multilayer sack or bag; and FIGS. 1*b* to 5*b* show simplified sections of the bag in the steps of FIGS. 1*a* to 5*a*.

DETAILED DESCRIPTION OF THE PREFERRED EMBODIMENT

Figure 1A:
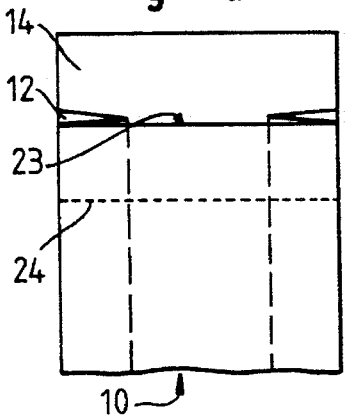
Figure 1B:
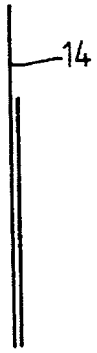

FIGS. 1*a* and 1*b* show a paper tubular web 10 which has side folds 12. At one end, there is formed a flap 14 which is formed as an extension of one of the sides of the tubular web.

Figure 2A:
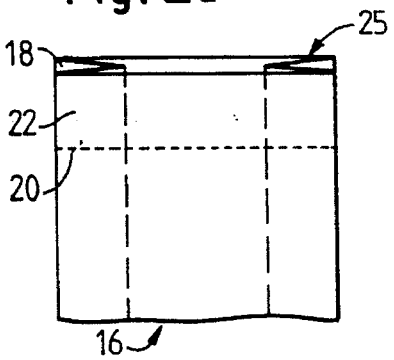
Figure 2B:
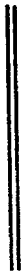

FIG. 2 shows a tubular web 16 which also has side folds 18, but in this arrangement the paper tubular web 16 has no extended flap.

Figure 3A:
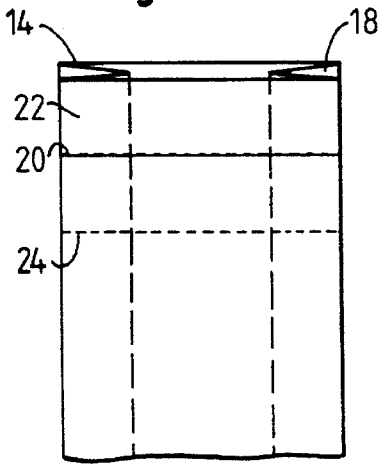
Figure 3B:
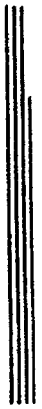

The tubular web 16 with side folds is inserted into the tubular web 10 of FIGS. 1*a* and 1*b* so as to provide the multilayer tubular web with side folds represented in FIGS. 3*a* and 3*b*, where the tubular web 16 with side folds forms the inner layer, while the tubular web 10 with side folds forms the outer layer. The open end of the tubular web 16 with side folds abuts the closing edge of the flap 14, thereby forming a strip 22 (cf. FIG. 3*a*) of the inner tubular web with side folds which extends parallel to the flap 14.

Figure 4A:
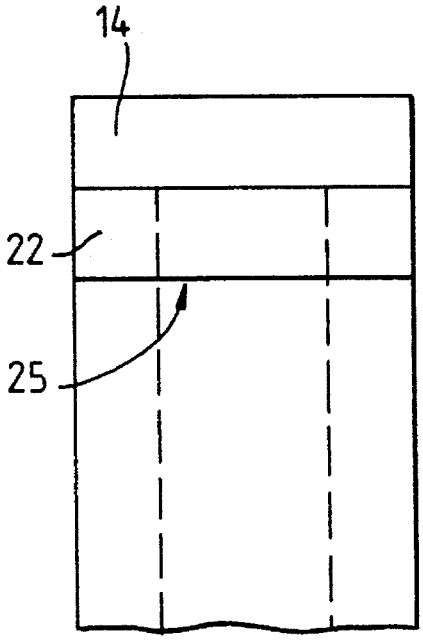
Figure 4B:
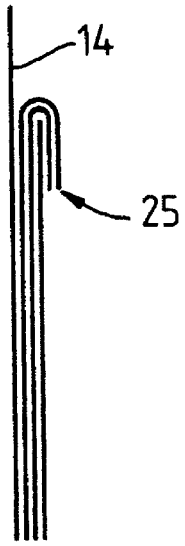

FIG. 4 shows this strip 22 of the inner tubular web 16 with side folds after it has been folded over along the fold line 20 extending transversely to the longitudinal direction of the tubular webs with side folds. This fold line 20 lies at the level of the closing edge 23 of the outer tubular web 10 with side folds. The folded-over strip 22 can be fixed, for example by means of an adhesive, on the outer side of the tubular web 10 with side folds.

Figure 5A:
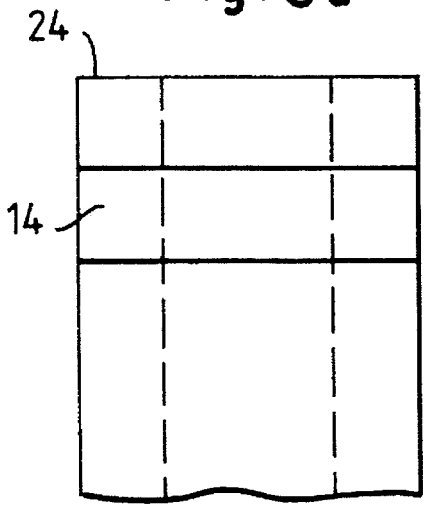
Figure 5B:
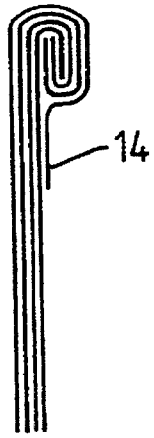

Subsequently the tubular webs 10 and 16 with side folds, inserted one into the other are folded once more round the distal edge 25 of the folded-over strip 22 to obtain the finished bottom represented in FIG. 5. Both the flap 14 and the refolded strip zone are joined, for example to the outer side of the tubular web 10, with side folds, by means of an adhesive.

I claim:

1. A multilayer bag having inner and outer tubular webs and side folds, wherein:

(a) said outer tubular web has side folds and comprises a projecting flap extending over a width of said outer tubular web, said projecting flap projecting beyond distal edges of a forward face extending over a width of said outer tubular web and said side folds of said outer tubular web;

(b) said inner tubular web has side folds and comprises distal edges in register with a distal edge of said flap;

(c) said inner tubular web comprises a projecting strip extending parallel to the flap and having said distal edges in register with said distal edge of the flap, wherein said projecting strip is folded over onto an outer side of the outer tubular web; and (d) the inner and outer tubular webs with side folds inserted one into the other are folded together round a distal edge of said folded-over strip and are fixed in this folded over position by said flap which is secured to said outer side of said outer tubular web.

* * * * *